United States Patent [19]

Berginski

[11] 4,286,126

[45] Aug. 25, 1981

[54] IGNITION SWITCH

[75] Inventor: Werner E. Berginski, Werdohl-Eveking, Fed. Rep. of Germany

[73] Assignee: Firma Leopold Kostal, Lüdenscheid, Fed. Rep. of Germany

[21] Appl. No.: 47,334

[22] Filed: Jun. 11, 1979

[30] Foreign Application Priority Data

Jun. 22, 1978 [DE] Fed. Rep. of Germany ..... 2827400

[51] Int. Cl.[3] ..... H01H 19/00; H01H 27/00

[52] U.S. Cl. ..... 200/11 C; 200/11 EA; 200/11 G; 200/42 A; 200/44

[58] Field of Search ..... 200/11 A, 11 C, 11 G, 200/11 E, 11 EA, 11 J, 11 K, 42 A, 44

[56] References Cited

U.S. PATENT DOCUMENTS

| | | | |
|---|---|---|---|
| 1,410,795 | 3/1922 | Borge, Jr. | 200/11 EA |
| 3,676,617 | 7/1972 | Miller | 200/11 G X |
| 3,683,133 | 8/1972 | Heap | 200/44 |
| 3,723,678 | 3/1973 | Heap | 200/42 A |
| 3,819,883 | 6/1974 | Heap | 200/11 C X |

FOREIGN PATENT DOCUMENTS

| | | | |
|---|---|---|---|
| 1328966 | 9/1973 | United Kingdom | 200/44 |

*Primary Examiner*—James R. Scott
*Attorney, Agent, or Firm*—Bacon & Thomas

[57] ABSTRACT

An ignition switch has contact plates held in a socket plate and with trip cams on the circumference of the socket plate. A switching wheel carries a plurality of contact springs, which abut on one side against a central contact and have contact arms switchable by means of the trip cams with respect to the contact plates. The contact springs also cooperate with a starter repetition lock. The central contact is in the form of a spherical shell segment and each contact spring has a spherical shell segment pressed with a prestressing force onto the spherical shell segment.

16 Claims, 7 Drawing Figures

IGNITION SWITCH

BACKGROUND OF THE INVENTION

This invention concerns an ignition switch with contact plates held in a socket plate, including a central contact, with trip cams on the circumference of the socket plate, a notched wheel accommodating a plurality of contact springs abutting against the central contact having contact arms switchable by means of the trip cams with respect to the contact plates, and with an ignition repetition lock.

Ignition switches of this type are known in numerous forms. These switches generally comprise liftoff contact bridges actuated by means of steeply rising trip cams. In each of these cases, special contact surfaces of expensive contact materials are required. On a switch shaft, a plurality of cooperating contact heads, designed in part as double contact heads, is needed.

SUMMARY OF THE INVENTION

The object of the invention is to provide mechanically and electrically safe and durable contactors for the supply of power to contact springs. The object is attained according to the invention by a central contact in the form of a segment of a spherical shell and each of a plurality of contact springs has a spherical shell segment pressed on said spherical shell segment with prestressing. The contact springs are thus located with their spherical shell segments on a spherical shell segment of the central contact. This results in a linear contact surface, so that a relatively large cross section is assured for the transfer of power. The spherical sheet segments also have a centering effect on the contact springs. This substantially improves the quality of the contact. It is then possible without additional measures to effect safe contact on the circumference of the contact springs.

A further development of the invention provides for a centering pin to be held in the upper part of a switching wheel and to extend centrally through all of the spherical shell segments. This results in the sure centering of the contact springs so that the individual contact springs cannot loosen even in the case of shocks and impacts.

The invention combines the contact springs into a contact spring disk consisting of a single piece, said disk comprising two annular contact springs and one radial contact spring. This form of embodiment of the invention leads to a particularly simple design, because only one contact spring disk is required, which, by virtue of its spring properties also supplies the necessary spring forces and prestressing forces.

The invention includes trip cams in the form of helically rising cam tracks, with the contact plates being located underneath the terminal edges thereof. This is a particularly important characteristic of the invention. The contact arms may be moved over slowly rising cam configurations so that the necessary torque may kept low. At the end of each of the trip cams the contact arm snaps onto the corresponding contact plate, so that the rapid, abrupt and safe establishment of the contact is assured. Either by means of the residual spring stresses of the contact springs or by the use of additional pressure springs, high contact pressure and thus safe contacting may be assured.

BRIEF DESCRIPTION OF THE DRAWINGS

The embodiments of the invention are described hereinbelow with reference to the drawings attached hereto, wherein.

DESCRIPTION OF THE PREFERRED EMBODIMENTS

Figure 1:
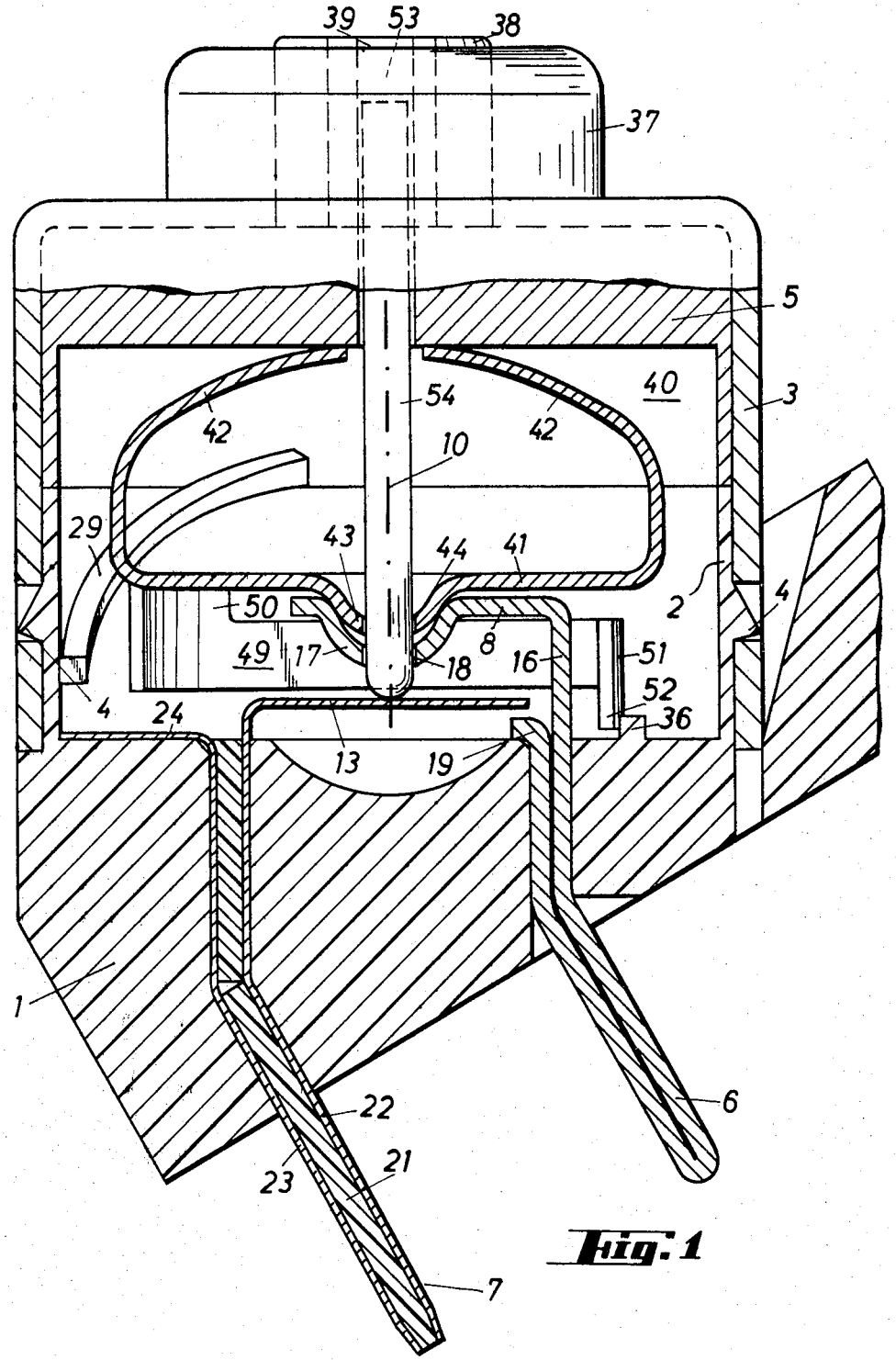
FIG. 1 is an axial section through a first embodiment of the ignition switch according to the invention.
Figure 2:
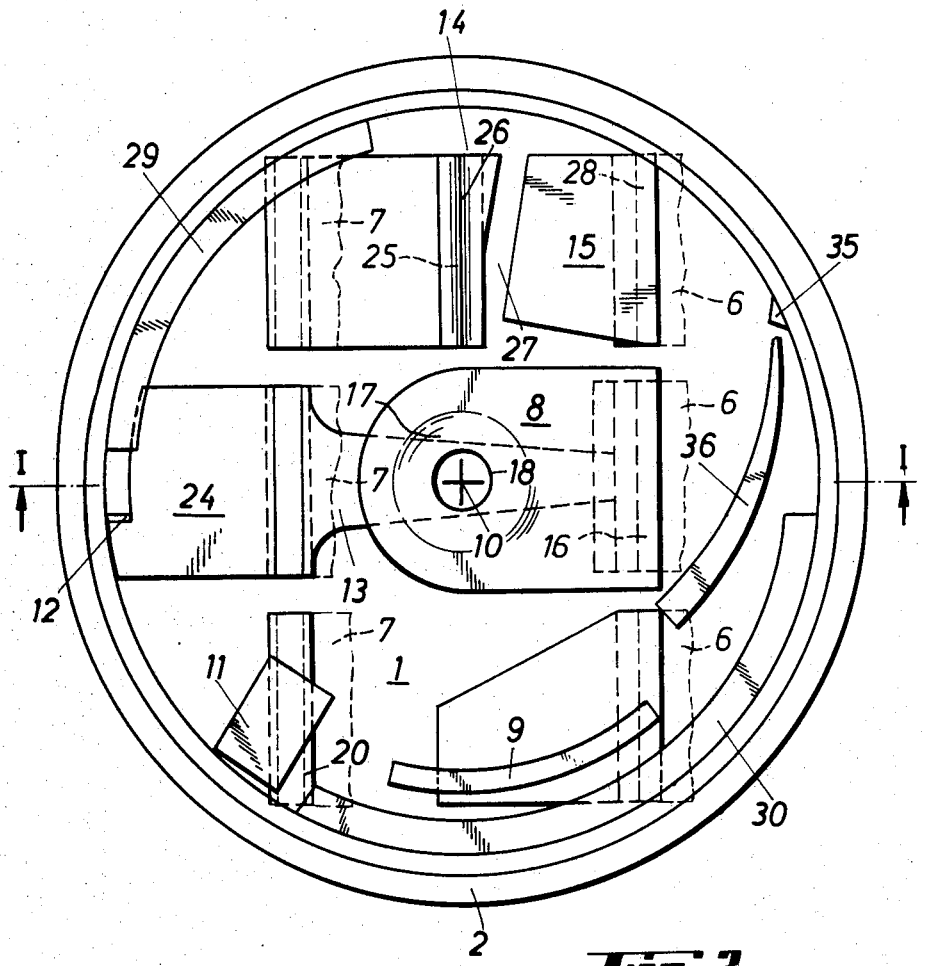
FIG. 2 is a top view of the socket plate.
Figure 4:
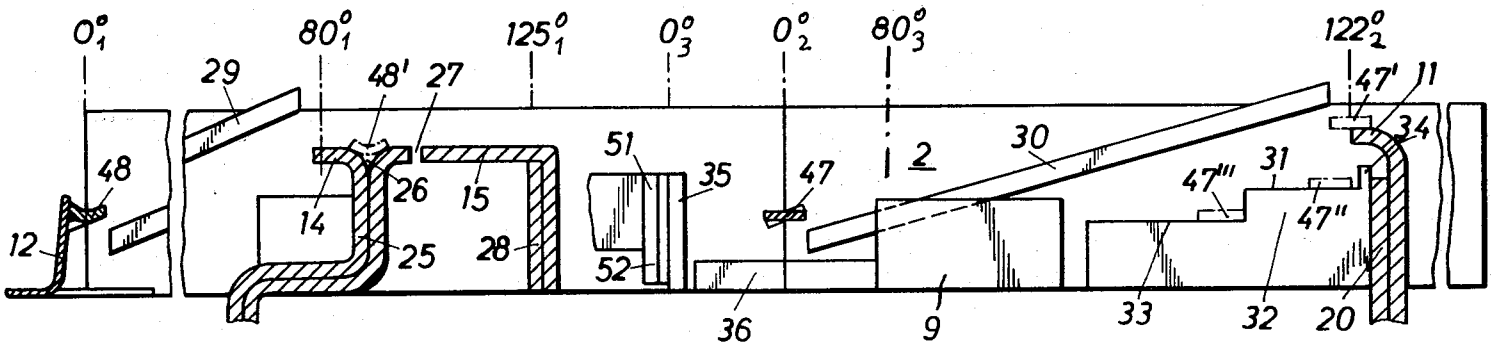
FIG. 4 is a developed view of the annular wall of the socket as viewed from the switching shaft.

FIG. 1 is a section through the ignition switch according to the invention. A socket plate 1 may be seen with an annular wall 2, a switch housing 3, connected by means of clamping connectors 4 with the annular wall 2, and a switching wheel 5, mounted rotatably within the switch housing 3. The ignition switch is designed to be used both in spark ignition engines and in diesel engines. The switch is capable of performing all pertinent functions, such as starting, ignition, disconnection of power users during the ignition process, parking light actuation, warning circuits, and the like. Contact plates, lead to the outside as contact plugs 6, 7 are held in the socket plate 1. These contact plugs 6, 7 are arranged in two parallel rows with three contact plugs in each row. This arrangement of the contact plugs is designed for a plug connection. The contact plugs 6, 7 each carries a contact plate formed as a single piece therewith, i.e., a central contact 8 (FIG. 2), an ignition contact plate 9 shaped as a segment of an annular wall concentric to the axis 10 of the socket plate, a starter contact plate 11, a parking light contact plate 12, a buzzer contact spring 13, a user disconnect contact plate 14 and a preheating contact plate 15. The form of the individual contact plates may be seen in FIGS. 1, 2 and 4. FIG. 4 is a development of the annular wall 2 of the socket plate 1 as viewed from the axis 10.

The middle contact plug 6 carries the central contact 8 on a bracket 16 so that the central contact 8 is located above the plane of the socket plate. The central contact 8 has a spherical shell segment 17, which is aligned with the axis 10 of the socket plate 1 and provided with a central passage 18. A contact leg 19 is further provided on the plug 6 and resting on the socket plate 1.

The ignition contact plate 9 is a segment of an annular wall, aligned concentrically with the axis 10 and intended for switching in the radial direction. The ignition contact plate 11 is bent around a bar 20 of the corresponding contact plug and essentially represents a rectangular contact plate. The contact plug 7 has an insulating core 21, carrying the contact parts 22 and 23 on either side, said parts being thinner than the sheet metal used for the rest of the contact plugs and contact plates, as clearly seen in FIG. 1. The contact part 22 carries the buzzer contact spring 13, which extends across the axis 10 os the socket plate and faces the contact leg 19 but is normally spaced therefrom. The parking light contact plate 12 is formed on contact plate 23 by way of a leg 24 and is in the form of a bar extending upward perpendicularly to the plane of the socket plate. The user disconnect contact plate 14 may be recognized by its configuration in FIG. 4 in combination with FIG. 2. A bar 25 directed upwardly from the plane of the socket 1 carries the user disconnect contact plate 14 and which defines a channel 26 extending in the radial direction; it serves simultaneously as a detent to define the ignition position of the switch. The preheating contact plate 15 is adjacent the user disconnect contact plate 14 at the same height, while leaving a gap 27 therebetween, this contact plate also is located on a bar 28 extending upwardly from the plane of the socket plate.

The socket plate 1 and the annular wall 2 are provided with a plurality of different switching configurations. On the annular wall there is a helically rising cam track 29, which follows the parking light contact plate 12 and terminates directly above the user disconnect contact plate 14. A similar helical cam track 30 is located with its base approximately diametrically opposed to the base of the cam track 29 and terminates directly in front of and above the starter contact plate 11. Underneath this cam track 30 and underneath the starter contact plate 11, there is a stepped blocking element 31 with two shaped steps 32, 33. The upper surface of the first step 32 is separated from the bar 20 of the starter contact plate 11 by a partition 34. On the annular wall 2, an approximately triangular cam 35 is provided (See also FIG. 3), the function of which will be explained in more detail hereinbelow. Finally, a spiral section 36 is formed on the socket plate 1, beginning in the vicinity of the cam 35 and terminating directly in front of ignition contact plate 9.

Figure 3:
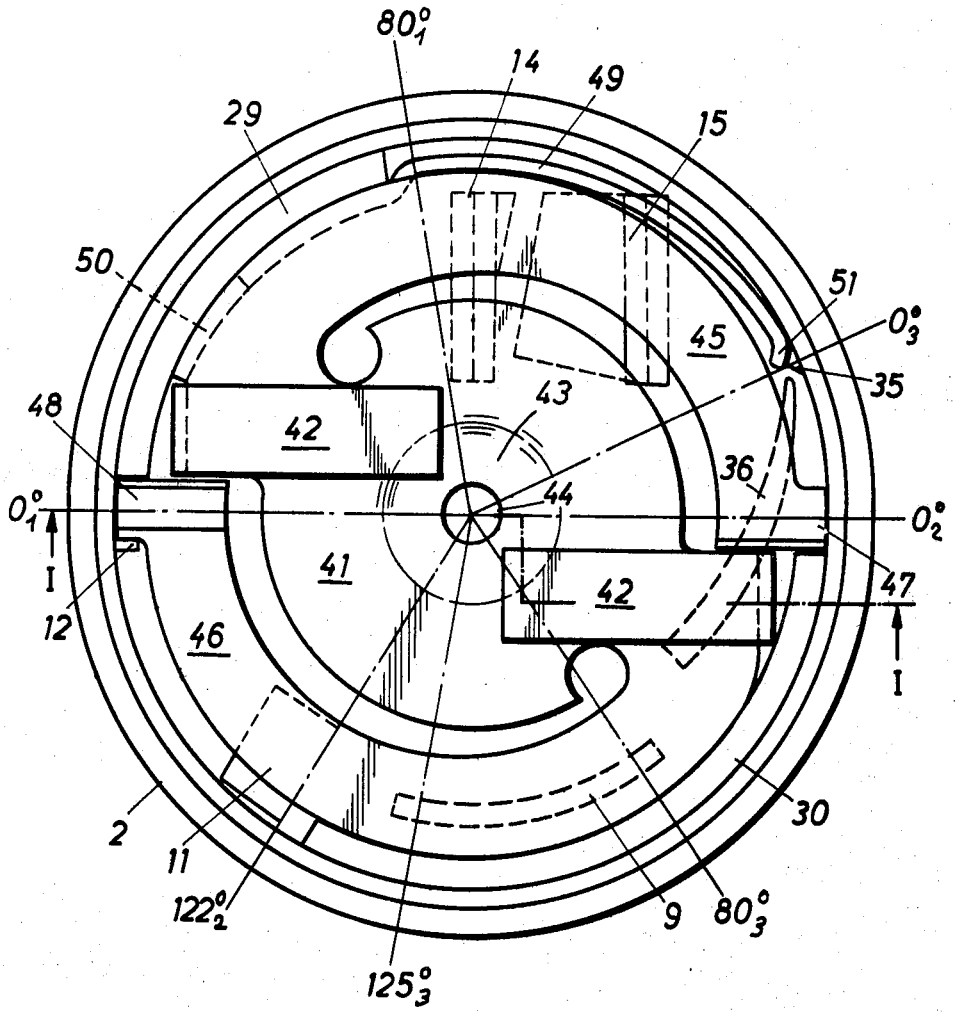
FIG. 3 is a top view corresponding to FIG. 2 with the contact spring disk inserted.

The switching wheel 5 is rotatably mounted in the switch housing 3. It has a projection 38 which extends through the dome 37 of the switch housing 3. The projection 38 has a driving section 39 for a driving pin (not shown) of the locking cylinder of a steering column lock. The driving pin effects the rotation of the switching wheel. Within the dome 37, a return spring is located, which serves to return the switching wheel from the starter position to the ignition position. This is known and will thus not be described in further detail. The switching wheel 5 has a receiving transverse slot 40. A contact spring disk 41 in the switching wheel 5 is equipped with at least two spring lashes 42 bent upwardly and inwardly approximately 180° and which extend into the slot 40 and thus center the contact spring disk 41 within the switching wheel 5. These spring lashes 42 also serve to frictionally drive the contact spring plate 41 during the rotation of the switch wheel 5. The spring lashes 42 also produce the necessary contact pressure. The contact spring plate 41 has in its center a spherical shell segment 43 with a central passage 44. The radius of curvature of the outer surface of the spherical shell segment 43 is larger than that of the inner surface of the spherical shell segment 17, so that the spring disk 41 rests with the spherical shell segment 43 in the spherical shell segment 17 so that it will not become jammed in the latter. Two annular contact springs 45 and 46 (FIG. 3) are cut onto the contact spring disk 41, and terminate in free ends in the form of radially outwardly directed contact arms 47 and 48, they are intended on the one hand for contact with the socket plate and on the other, are guided on the trip cams 29 and 30. The contact springs 45 and 46 are prestressed in the axial direction, so that they are biased in the direction toward the socket plate. Further, the cutout 50 of a radial contact spring 49 is located on the circumference of the contact spring disk 41. The cutout 50 is bent at right angles with respect to the plane of the contact spring disk 41. The radial contact spring 49 has a generally circular configuration so that its end rests against the annular wall 2 of the socket plate 1; see particularly FIG. 3. The radial contact spring 49 terminates in a contact arm 51 (see FIG. 1) with a guiding beak 52 directed downward, and which cooperates with the spiral section 36. Within the switch wheel 5 there is a central passage 53, aligned with the axis 10 of the socket plate 1. A centering pin 54 is located in the passage 54 and extends through the passage 18 of the central contact 8 and the passage 44 of the contact spring disk 41 and rests on the center contact spring 13. The centering pin 54 passes centrally through the passage 53 of the switching wheel 5 and through the passage 18 of the central contact 8 within the switch, so that the centering pin 54 actually centers the contact spring disk 41. The centering pin 54 normally is held in the position indicated in FIG. 1 by the prestressing of the buzzer contact spring 13. The buzzer circuit is open, because the end of the buzzer contact spring 13 is spaced from contact leg 19. When the ignition key is inserted in the steering lock, the driving pin of the locking cylinder is pressed downward, so that the centering pin is also pushed downward, thus urging the buzzing contact spring 13 against the contact leg 19. This closes the buzzer circuit. The mode of operation of the above-described ignition switch will now be explained. In FIG. 3 the contact spring disk 41 is represented in position for the base setting of the ignition switch, wherein the ignition key is withdrawn. According to FIG. 1, the centering pin 54 is raised in this position, so that the buzzer circuit is open. The contact arm 48 of the annular contact spring 46 is in its zero position $0_1°$ at the upwardly extending parking light contact plate 12; see also FIG. 4. By means of the parking light contact plate 12, the parking light circuit and possibly other circuits which are to be supplied by the power source of the vehicle during parking, are actuated. In this base state of the ignition switch, the contact arm 51 of the radial contact spring 49 abuts against the cam 35; see the radial contact spring position $0_3°$. The cam 35 produces by way of the radial contact spring 49 a stress in the counterclockwise direction with respect to FIG. 3, so that contact pressure for the contact arm 48 on the parking light contact plate 12 is established. The contact arm 47 of the annular contact spring 45 is located in this base state directly at the start of the cam track 30 (FIGS. 3 and 4).

When the ignition key is inserted in the steering lock to start the vehicle, the centering pin 54 is urged against the socket plate 1 by means of the driving pin of the lock cylinder, so that the buzzing contact spring 13 makes contact with the contact leg 19. The buzzer circuit is then closed, whereby various warning functions or surveillance circuits may be actuated. To start the vehicle, the ignition key is turned. In the process, the contact spring disk 41 rotates in the clockwise direction, as seen in FIG. 3. The contact arms 47, 48 and 51 then move to the right, in relation to FIG. 4. The contact arms 47 and 48 are raised by the helical section cams 30 and 29. The guide beak 52 of the contact arm 51 travels along the spiral cam 36, so that the radial contact spring 49 is stressed radially inwardly. When the angle of rotation amounts to approximately 80°, the contact arms 48 drops onto the user disconnect switch contact 14 (see the dash-and-dot position 48'in FIG. 4). The guide beak 52 passes the apex of the spiral cam 36, so that the contact arm 51 deflects radially outward against the ignition contact plate 9, thus closing the ignition circuit; see the angular position $80_3$° in FIG. 4. The contact arm 47 is then still travelling upwardly along the cam track 30. With further rotation, the contact arm 48 leaves the user disconnect contact plate 14 and reaches the preheat contact plate 15. The abandonment of the user disconnect contact plate 14 disconnects the user circuits in order to free the battery of the vehicle for the starting process as much as possible. Finally, at an angle of rotation of 120° to 125°, the contact arm 47 reaches the top of the cam track 30 and drops onto the starting contact plate 11; observe the angular position $122_2$° in FIG. 4 and the dash-and-dot position 47'. The starting motor is now actuated. The ignition circuit is maintained by means of the ignition contact plate 9. When the ignition key is released or rotated in the opposite direction, the switching wheel 5 and thus the contact spring disk 41, are rotated in the counterclockwise direction with respect to FIG. 3. The contact arm 47 is thereby moved to the left as seen in FIG. 4 and is dropped from the position 47' onto the cam step 32, into position 47''. The partition 34 prevents the rotation of the contact spring disk 41 in the clockwise direction, so that the contact arm 47 can no longer abut against the starting contact plate 11. The lock cam 31 thus acts as a starter repetition lock out. The return spring returns the switching wheel and thus the contact spring disk 41 to the point where the contact arm 47 drops onto the cam step 33 in its position 47'''. The contact arm 48 attains a locking position in the detent channel 26, thus defining the locked position of the switch. The contact arm 51 of the radial contact spring 49 remains permanently urged against the ignition contact plate 9. To deactivate the engine, the ignition key is moved to the parking position, whereby the contact spring disk 47, 48 is returned to its initial position. The contact arms 47, 48 and 51 thereby attain their initial position, to the left as seen in FIG. 4. Reignition is possible from this position. Upon the withdrawal of the ignition key, the buzzer circuit is interrupted by the prestress of the buzzer contact spring 13, which also raises the centering pin 54.

Figure 5:
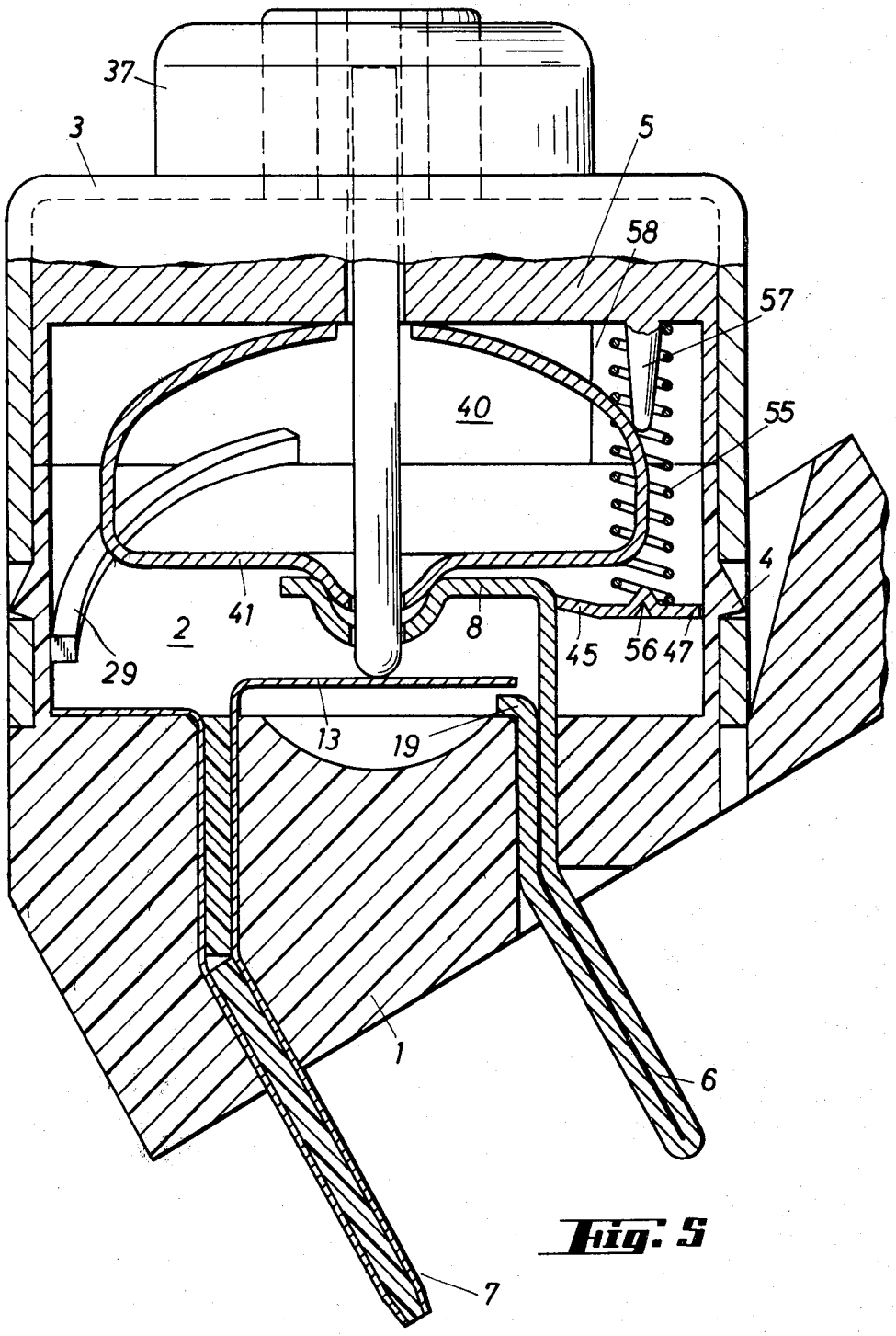
FIG. 5 is a modified embodiment of the ignition switch.

The modified form of the invention shown in FIG. 5 is similar to the above-described embodiment in design. The contact arms of the annular contact springs are, however, prestressed additionally by a compression spring 55 for each, as illustrated for the contact arm 47 of the annular contact spring 45. A hump 56 embossed from the contact arm 47 to retain the compression spring 55, said compression spring being held on a gudgeon 57 located in an extension 58 of the receiving chamber 40. A similar compression spring is provided for the contact arm 48 of the annular contact spring 46 but is not shown in the drawing. These compression springs enhance the contact pressure and also the safety of switching and the reversing velocity, because the springs accelerate the contact arm involved during the process of contacting so that the contact arm impacts the corresponding contact plate with a high velocity.

Figure 6:
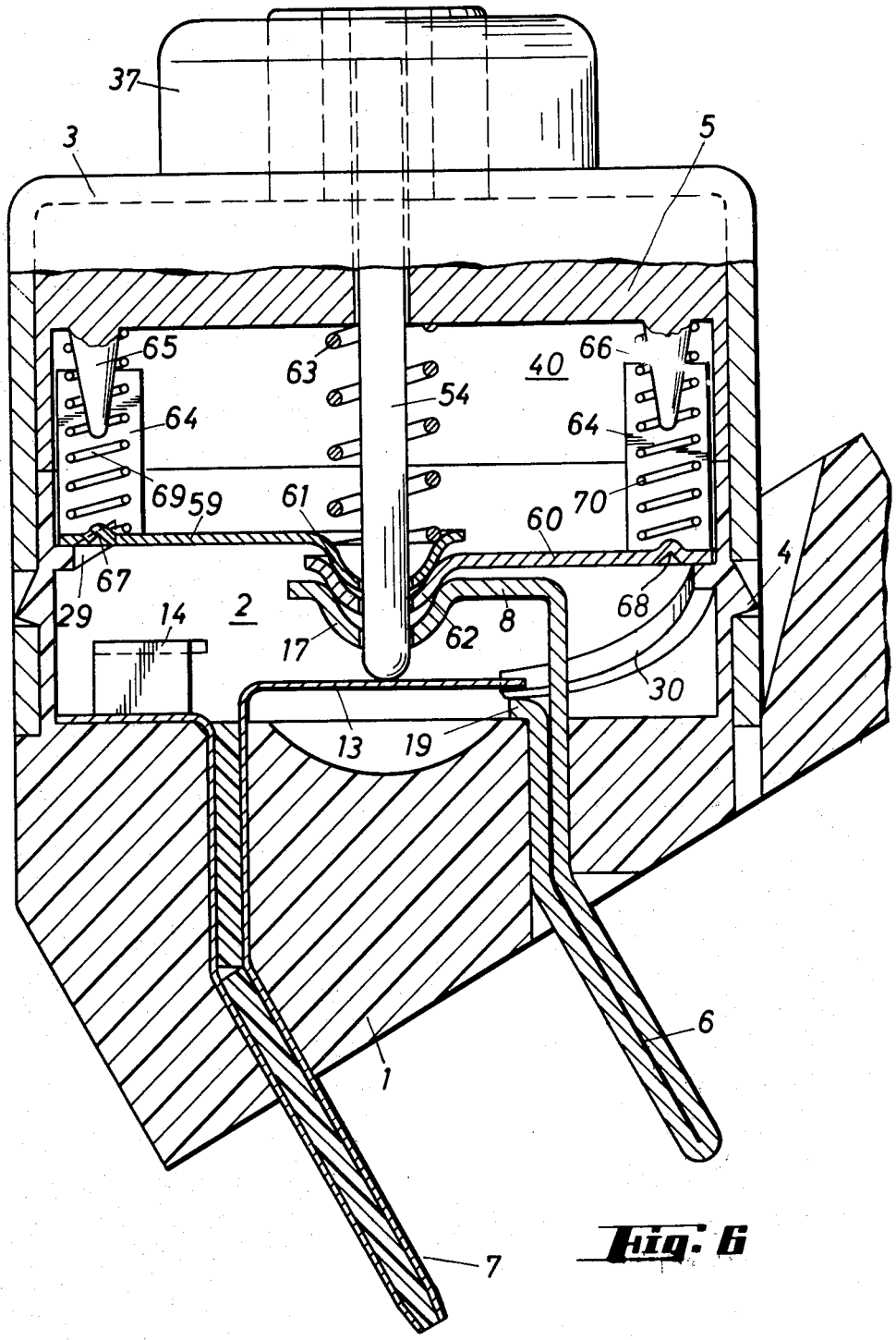
FIG. 6 is a further modification of the switch according to the invention.
Figure 7:
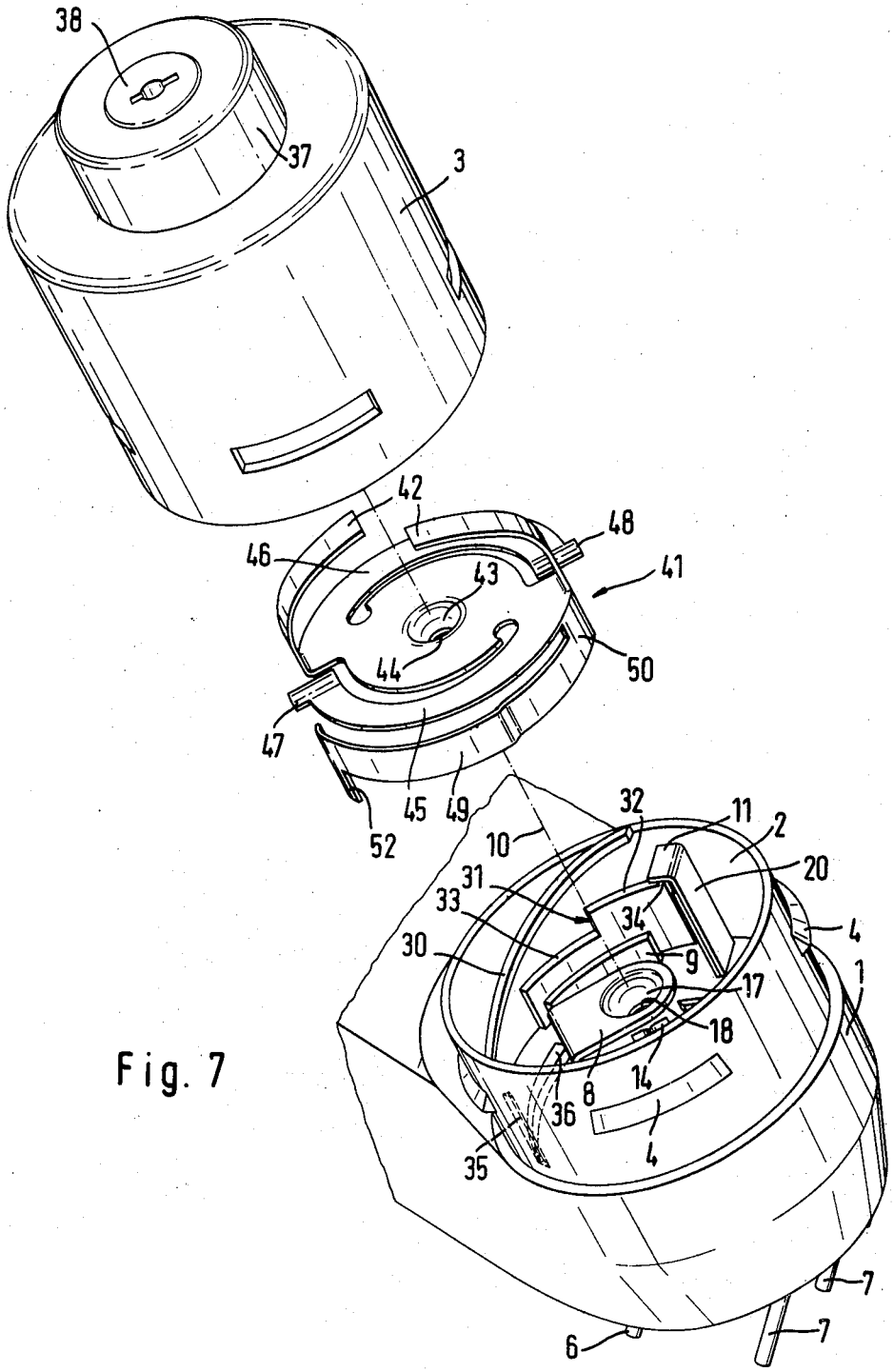
FIG. 7 is an exploded perspective view of the principal parts of the applicant's switch according to the invention.

FIG. 6 shown another embodiment of an ignition switch. The switching wheel 5 comprises a plurality of contact springs 59, 60. Each contact spring 59, 60 comprises a spherical shell segment 61, 62, which fit the spherical shell segment 17, so that all of the spherical shell segments may be stacked into each other. The centering pin 54 here again additionally serves to guide a compression spring 63, which bears at one end against the inner wall of the chamber 40 and at its other end against the inside of the spherical segment 61. This spring 63 provides the contact pressure for the spherical shell segments. Each contact spring 59 and 60 has at its outer end two spaced legs 64, bent upwardly at right angles, said legs being guided along the vertical walls of the receiving chamber 40, thus preventing the contact springs 59 and 60 from tilting and also embracing the springs 69, 70 during the rotation of the switching wheel 5. The gudgeons 65, 66 are located within the receiving chamber 40. The humps 67,68 are embossed at the ends of the contact springs between the legs 64. One of the helical compression springs 69, 70 bears at one end against one of the humps 67, 68, and at its other end against a gudgeon 65, 66. These helical springs provide the contact pressure for the contacting of the corresponding contact plates. In FIG. 6, a contact plate 14 is shown schematically. The outer ends of the contact springs 59 and 60 also slide over the cam tracks 29 and 30. The switching mode is thus identical with the one described hereinabove.

If necessary, additional contact springs may be provided, so that another contact spring is available, besides the two contact springs 59 and 60. The contact springs may then be offset with respect to each other by approximately 120° in the circumferential direction. Correspondingly, three switching cams are provided. The switch may be adapted in relation to its switching program to the applications desired.

I claim:

1. In an ignition switch having a socket plate provided with a generally circular array of contacts and a central contact, and a switching wheel rotatable in a forward direction about an axis coincident with the axis of said array, said switching wheel including contact springs sequentially engageable with the contacts of said array when said wheel is rotated in said forward direction and a central contact engaging the central contact of said socket plate, the improvement comprising:

said central contacts being in the form of spherical shell segments, one nested within the other.

2. Ignition switch according to claim 1 wherein said contact springs are integral with a contact spring plate (41) comprising a portion of said switch wheel, said contact spring plate having two annular contact springs (45, 46) and a radially extending contact spring (49).

3. Ignition switch according to claim 2 wherein the contact spring disk (41) comprises a plurality of spring lashes (42) bent upwardly approximately 180° from the switching wheel, said lashes reacting against a portion of said switching wheel and providing axial contact pressure.

4. Ignition switch according to claim 2 wherein said radial contact spring (49) is bent approximately at right angles with respect to the plane of the spring disk (41) and extends downwardly at the circumference of the spring disk.

5. Ignition switch according to claim 1 wherein at least one of said contacts (12) of said circular array comprises an upstanding contact bar and one of said contact springs (46) is engageable with a side thereof and a cam element (35) arranged in said circular array to engage a portion of said contact spring plate to urge said contact spring (46) against said contact bar (12).

6. Ignition switch according to claim 2 wherein certain of said contact springs (45, 46) are arranged in substantially coplanar relation and are prestressed to flex downwardly.

7. Ignition switch according to claim 6 including trip cams (29, 30) arranged on said socket plate arranged to engage and lift said substantially coplanar contact springs (45, 46).

8. Ignition switch according to claim 6 wherein additional springs are provided on said switching wheel arranged to urge said contact springs downwardly.

9. Ignition switch according to claim 6 wherein at least one of said contacts of said circular array is provided with a detent channel (26) arranged to receive a portion of one of said contact springs to releasably hold said switching wheel in a predetermined position.

10. Ignition switch according to claim 2 including a cam segment on said socket plate arranged to extend spirally of the axis thereof and engageable with said radially extending contact spring (49) and a contact of said array being positioned radially outwardly from and adjacent the inner end of said cam segment.

11. Ignition switch according to claim 2 wherein one of said contacts of said array is a starter contact, there being a stepped lock cam (31) on said socket plate below said starter contact whereby a contact spring (48) drops off said starter contact and onto said lock cam when said contact wheel is rotated in a reverse direction.

12. Ignition switch according to claim 11 wherein said lock cam includes a barrier (34) comprising an insulating barrier to insulate said contact spring (48) from said starter contact when said contact spring is on said stepped lock cam.

13. Ignition switch according to claim 11 wherein said stepped lock cam has a two-step configuration.

14. Ignition switch according to claim 1 including a centering pin extending centrally through said spherical shell segments.

15. Ignition switch according to claim 5 wherein the central contact (8) is arranged on a connecting bar (16) spaced from the socket plate and wherein the centering pin (54) is displaceable in the axial direction and wherein it rests on a contact spring (13) resiliently engageable with a portion of said central contact for the actuation of an additional switching circuit.

16. Ignition switch according to claim 14 wherein said switching wheel includes a portion comprising a plurality of members having said nested spherical segments, a compression spring (63) on said switching wheel and around said centering pin for holding the spherical segments of said plurality of members in said nested relationship, each of said members having at least one of said spring contacts thereon, and further springs (69, 70) on said wheel urging the outer ends of said spring contacts downwardly.

* * * * *